US008122872B2

(12) United States Patent
Kim

(10) Patent No.: US 8,122,872 B2
(45) Date of Patent: Feb. 28, 2012

(54) FUEL PUMP MODULE FOR ETHANOL FUEL VEHICLE

(75) Inventor: Chang Han Kim, Gwangju (KR)

(73) Assignee: Hyundai Motor Company, Seoul (KR)

( * ) Notice: Subject to any disclaimer, the term of this patent is extended or adjusted under 35 U.S.C. 154(b) by 692 days.

(21) Appl. No.: 12/324,517

(22) Filed: Nov. 26, 2008

(65) Prior Publication Data

US 2009/0260600 A1 Oct. 22, 2009

(30) Foreign Application Priority Data

Apr. 17, 2008 (KR) ..... 10-2008-0035767

(51) Int. Cl.
*F02M 37/10* (2006.01)

(52) U.S. Cl. ..... 123/549; 123/557; 219/628

(58) Field of Classification Search ..... 123/509, 123/549, 557; 417/313, 572; 219/628
See application file for complete search history.

(56) References Cited

U.S. PATENT DOCUMENTS

| | | | | |
|---|---|---|---|---|
| 5,099,909 | A * | 3/1992 | Barigelli | 165/41 |
| 5,454,697 | A * | 10/1995 | Nakanishi | 417/423.3 |
| 6,118,111 | A * | 9/2000 | Price et al. | 219/629 |
| 6,179,577 | B1 | 1/2001 | Meyer | |
| 7,150,269 | B2 * | 12/2006 | de Monts de Savasse et al. | 123/510 |

FOREIGN PATENT DOCUMENTS

JP 2004-28054 A 1/2004

* cited by examiner

*Primary Examiner* — Mahmoud Gimie
*Assistant Examiner* — David Hamaoui
(74) *Attorney, Agent, or Firm* — Morgan, Lewis & Bockius LLP

(57) ABSTRACT

A fuel pump module for an ethanol fuel vehicle, which is mounted on a fuel tank for storing ethanol fuel and is provided with a pump and a supply portion for pressure-feeding the ethanol fuel stored in the fuel tank to an engine, may include a heater unit that is disposed therebetween and is fluid-communicated to the pump and the supply portion through a connection hose so as to heat by electrical resistance the ethanol fuel supplied to the heater unit through the pump.

17 Claims, 5 Drawing Sheets

FUEL PUMP MODULE FOR ETHANOL FUEL VEHICLE

CROSS-REFERENCE TO RELATED APPLICATION

The present application claims priority to Korean Patent Application Number 10-2008-0035767 filed Apr. 17, 2008, the entire contents of which application is incorporated herein for all purposes by this reference.

BACKGROUND OF THE INVENTION

1. Field of the Invention

The present invention relates to a fuel pump module for vehicles, and more particularly to a fuel pump module that provides an engine with ethanol fuel stored in a fuel tank.

2. Description of Related Art

In recent years, studies on fuel systems using a fuel pump for pumping ethanol fuel as a bio-energy source have increased in correspondence with the tendency toward environmentally friendly and less expensive fuels.

In foreign countries, ethanol fuel vehicles that meet legal regulations and that are environmentally friendly are being sold, and sale volumes are increasing.

However, such an ethanol fuel vehicle using ethanol fuel has a problem in that startability thereof is deteriorated because of low volatility, which is a characteristic of ethanol fuel.

In order to improve this problem, ethanol fuel vehicles employ gasoline from an auxiliary fuel tank during start-up.

In a fuel supply system of an ethanol fuel vehicle according to the prior art as shown FIG. 1, firstly, a fuel pump module is disposed to a fuel tank 101 for provide an engine with ethanol fuel.

The fuel pump module 103 is communicated to the engine 105 through a fuel hose 107 and to a canister that collects fuel evaporation gas that is recirculated to an intake pipe of the engine 105 through the fuel tank 101.

The canister 109 is communicated to an auxiliary fuel tank 111 that is filled with gasoline fuel, and the auxiliary fuel tank 111 is connected to the engine 105 in the engine compartment so as to improve startability of ethanol fuel vehicles.

Thus, during start-up of an ethanol fuel vehicle, gasoline is supplied from the auxiliary fuel tank 111 so as to operate the engine 105, and after the start-up of the engine 105, the ethanol fuel of fuel the fuel tank 101 is supplied by the fuel pump module 103 so as to operate the engine 101.

However, because a fuel pump module according to the prior art merely provides the engine with ethanol fuel in the fuel tank, it is necessary to install the auxiliary fuel tank in the engine compartment to improve deterioration of start-up that is caused by low vapor-pressure. However, this increases complexity of design of the inside of the engine compartment, and causes an increase in cost because of the manufacturing of the auxiliary fuel tank.

Further, a leak of fuel caused by collision between vehicles may occur, and frequent fuel-supply is required because the auxiliary fuel tank is too small.

The information disclosed in this Background of the Invention section is only for enhancement of understanding of the general background of the invention and should not be taken as an acknowledgement or any form of suggestion that this information forms the prior art already known to a person skilled in the art.

BRIEF SUMMARY OF THE INVENTION

Various aspects of the present invention are directed to provide a fuel pump module for an ethanol fuel vehicle having advantages of improving startability of the vehicle by heating ethanol fuel for an engine from the fuel tank during start-up, and that is capable of reducing manufacturing cost.

In an aspect of the present invention, a fuel pump module for an ethanol fuel vehicle, which is mounted on a fuel tank for storing ethanol fuel and is provided with a pump and a supply portion for pressure-feeding the ethanol fuel stored in the fuel tank to an engine, may include a heater unit that is disposed therebetween and is fluid-communicated to the pump and the supply portion through a connection hose so as to heat by electrical resistance the ethanol fuel supplied to the heater unit through the pump.

The fuel pump module may further include a power supply connector electrically coupled to the heater unit in order to supply electric current to the heater unit.

The heater unit may include an upper body including a first nipple so as to be fluid-communicated to the supply portion through the connection hose, a lower body including a second nipple so as to be fluid-communicated to the pump through the connection hose, wherein the lower body is coupled to and enclosed by the upper body in order to form an inner space therebetween, a heating member mounted in the inner space and receiving electrical current from a power supply so as to generate heat, upper and lower plates mounted respectively at upper and lower portions of the heating member so as to emit the heat generated from the heating member into the inner space, the upper and lower plates having respective penetration hole fluid-communicating with the first and second nipples therethrough, and/or an elastic member disposed in the inner space and biasing the upper plate and/or the lower plate toward the heating member to closely contact the upper and/or lower plates to the heating member.

A connection socket having a terminal may be mounted to the upper body and electrically connected to a power supply connector for receiving the electric current of the power supply.

The penetration holes of the upper and lower plates may be coaxially aligned. The first nipple and the penetration hole of the upper plate may be coaxially aligned. The second nipple and the penetration hole of the lower plate may be coaxially aligned.

A first elastic member may be interposed between the upper body and the upper plate and biases the upper plate toward the heating member to closely contact the upper plate to the heating member. A second elastic member may be interposed between the lower body and the lower plate and biases the lower plate toward the heating member to closely contact the lower plate to the heating member. The lower plate may be spaced from the lower body toward the upper body with a predetermined distance. The upper plate may be spaced from the upper body toward the lower body with a predetermined distance.

The heating member may be a PTC (positive temperature coefficient) thermistor.

The lower body may be thermally bonded to lower end portion of the upper body.

The supply portion may be fluid-communicated to the engine through a supply hose having an inner pipe through which the ethanol fuel passes and an outer pipe enclosing the inner pipe.

An insulator may be interposed between the inner pipe and the outer pipe. The insulator may be made of a rubber. The insulator may be made of SANTOPRENE® or other suitable a TPE (thermoplastic elastomer) series.

The upper plate and/or the lower plate may be made of a material selected from the group consisting of copper, aluminum, and iron.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
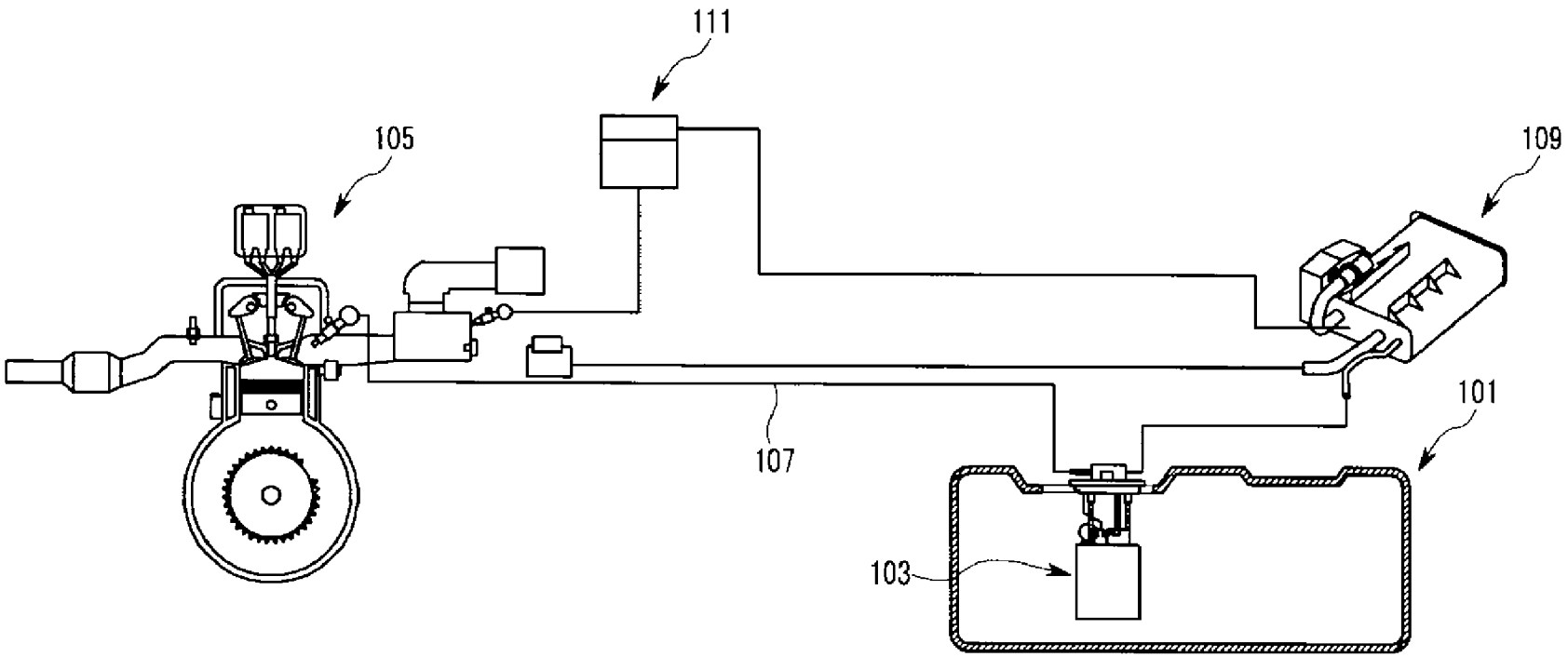
FIG. 1 (Prior Art)
FIG. 1 is a schematic diagram showing a fuel supply system of a conventional fuel pump module for an ethanol fuel vehicle.
Figure 2:
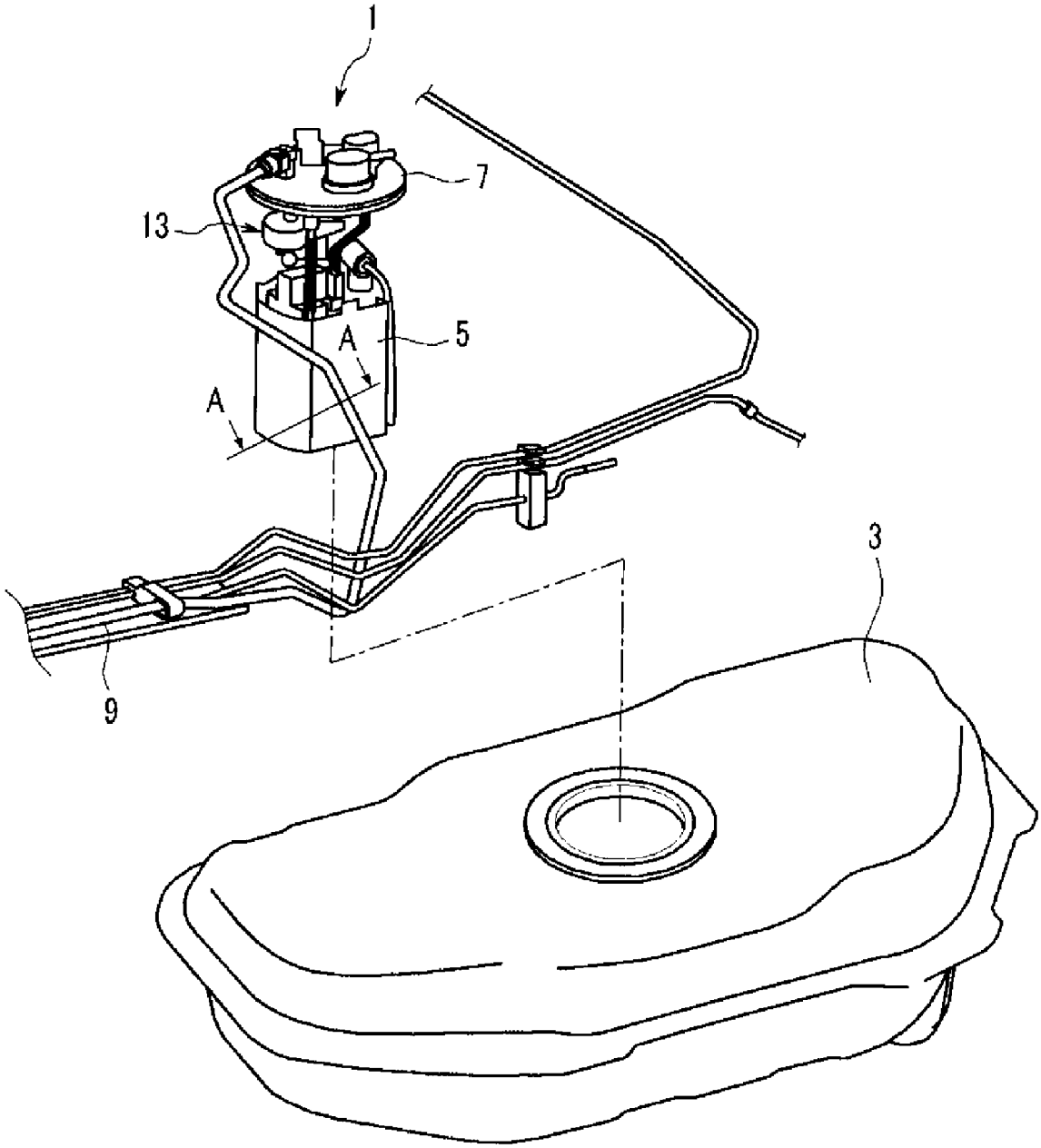
FIG. 2 shows a connecting relation of an exemplary fuel pump module for an ethanol fuel vehicle according to the present invention.
Figure 3:
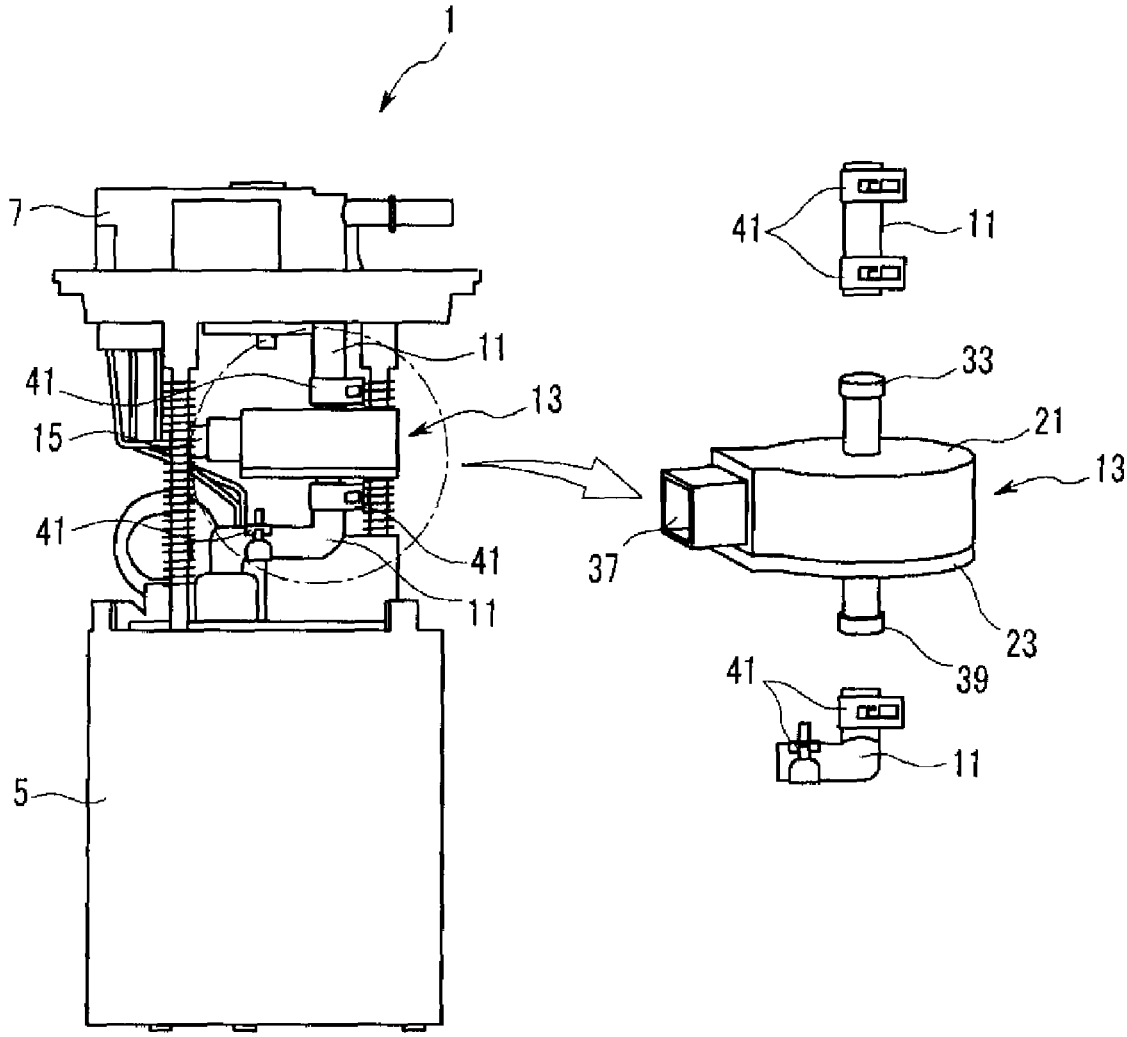
FIG. 3 is a perspective view showing an exemplary fuel pump module for an ethanol fuel vehicle according to the present invention.
Figure 4:
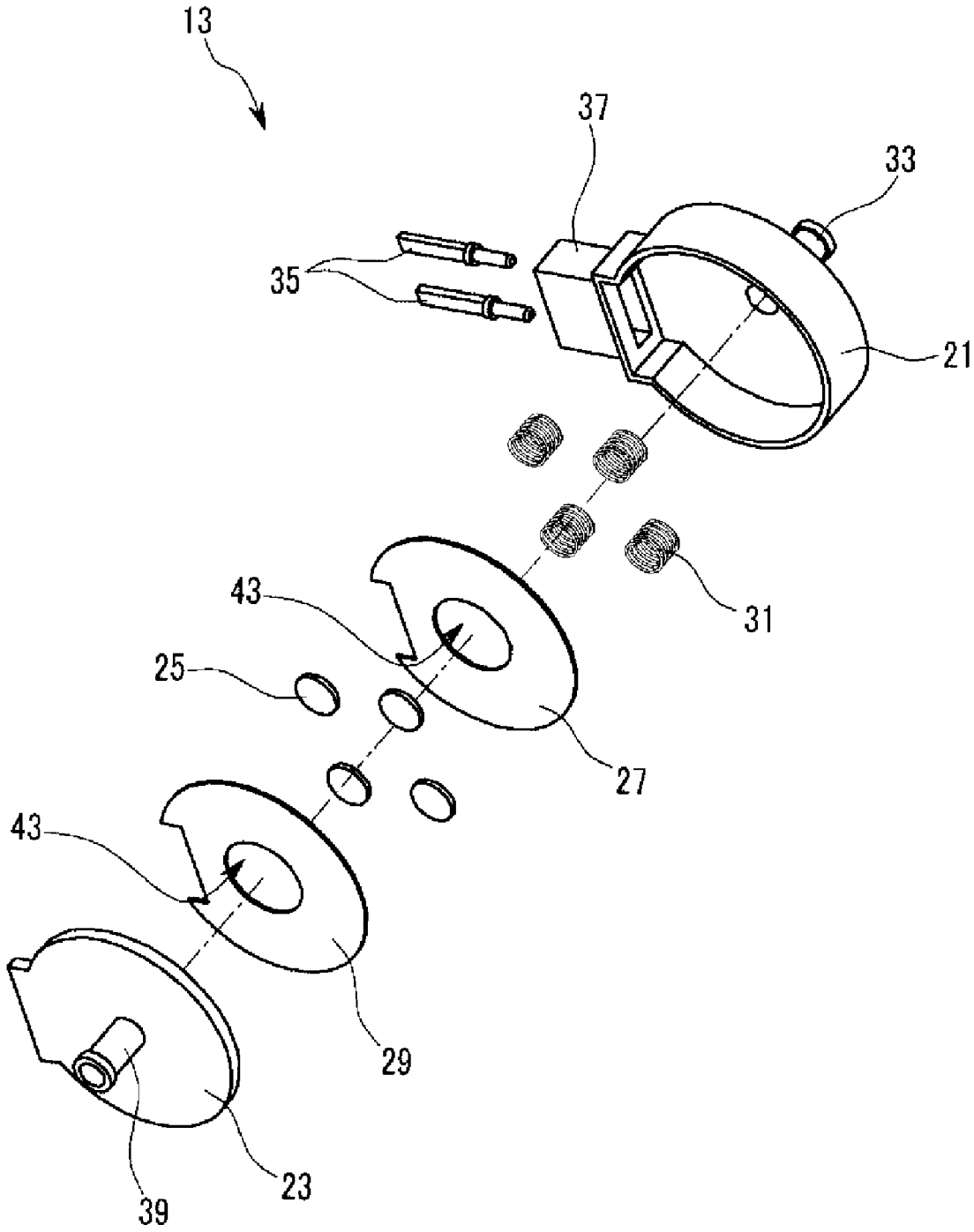
FIG. 4 is an exploded perspective view of an exemplary fuel pump module for an ethanol fuel vehicle according to the present invention.
Figure 5:
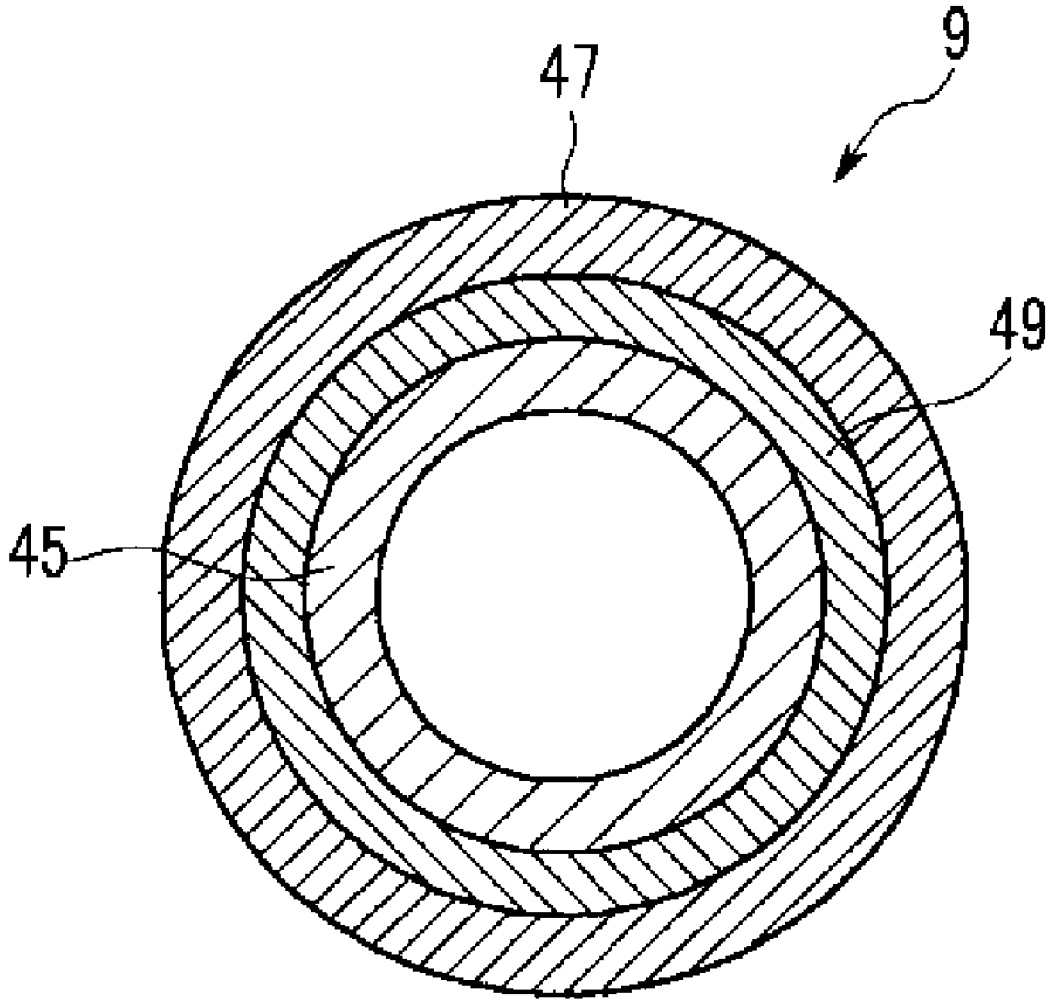
FIG. 5 is a cross-sectional view according to line A-A of FIG. 2 that shows an exemplary supply hose connected to an exemplary fuel pump module for an ethanol fuel vehicle according to the present invention.

FIG. 1 is a schematic diagram showing a fuel supply system according to an exemplary conventional fuel pump module for an ethanol fuel vehicle. FIG. 2 shows a connecting relation of a fuel pump module for an ethanol fuel vehicle according to various embodiments of the present invention. FIG. 3 is a perspective view showing a fuel pump module for an ethanol fuel vehicle according to various embodiments of the present invention. FIG. 4 is an exploded perspective view of a fuel pump module for an ethanol fuel vehicle according to various embodiments of the present invention. FIG. 5 is a cross-sectional view according to line A-A of FIG. 2 that shows a supply hose connected to a fuel pump module for an ethanol fuel vehicle according to various embodiments of the present invention.

As shown in the drawings according to various embodiments of the present invention, a fuel pump module 1 is substantially mounted in a fuel tank 3 that stores ethanol fuel.

Herein, the fuel pump module 1 comprises a pump 5 and a supply portion 7 so as to pressure-feed ethanol fuel stored in the fuel tank 3 to the engine.

In this case, the pump 5 is installed to the inside of the fuel tank 3 and supplies the ethanol fuel to the supply portion 7 by pumping.

The supply portion 7 is connected to an engine via a supply hose 9, and supplies the ethanol fuel pumped by the pump 5 to the engine.

Such a fuel pump module 1 according to various embodiments of present invention provides the engine with heated ethanol fuel so as to improve startability of vehicles and reduce the cost for manufacturing thereof.

To this end, as shown in FIG. 2 and FIG. 3, the fuel pump module for a vehicle according to various embodiments of the present invention includes a heater unit 13 interposed between the pump 5 and the supply portion 7, and a power supply connector 15 so as to provide the heater unit 13 with an electrical current.

The heater unit 13 heats ethanol fuel supplied to engine via the pump 5 by electrical resistance.

Further, the power supply connector 15 is disposed so as to be electrically connected to the heater unit 13.

In various embodiments of the present invention, the heater unit 13 is connected to the pump 5 and the supply portion 7 through a connection hose 11, and as shown in FIG. 4 includes an upper body 21, a lower body 23, four PTC elements 25, an upper plate 27, a lower plate 29, and a spring 31.

A first nipple 33 is interposed on an upper surface of the upper body 21 between the connection hose 11 and the upper body 21 to be communicated to the supply portion 7.

Further, a connection socket 37 electrically coupled to the power supply connector 15 is disposed to the upper body 21.

Herein, the connection socket 37 has a terminal 35 so as to provide current from the power supply connector 15.

The lower body 23 is disposed on the lower end portion of the upper body 21 in order to form an inner space therebetween.

Herein, the lower body 23 is preferably thermally bonded to the lower end of the upper body 21.

In addition, a second nipple 39 is disposed to the lower surface of the lower body 23 and connected to the pump 5 through the connection hose 11.

The lower body 23 provides a function of preventing leakage between the upper body 21 and the lower body 23 while ethanol fuel supplied by the pump 5 is moving to the supply portion 7.

Ends of the connection hose 11 are secured between the first nipple 33 and the supply portion 7, and between the second nipple 39 and the pump 5, respectively, with clamps 41.

The PTC (positive temperature coefficient) thermistor elements 25 generate heat with a current received by the power supply connector 15.

Further, the PTC elements 25 are disposed within the predetermined space and are electrically connected to the terminal 35 of the connection socket 37.

Heat is generated if current flows to the PTC elements 25 as semiconductor elements at a current exceeding a predetermined current, and if the temperature thereof reaches a switching temperature by self-heating the PTC elements 25, the current is prevented from flowing as a result of an increase of electrical resistance so as to maintain the temperature of the PTC elements 25 at a predetermined temperature.

The PTC elements 25 may be conventional heating elements that can be easily realized by a person of ordinary skill in the art The upper plate 27 and the lower plate 29 that are symmetrically arranged with respect to a center of each PTC elements 25 radiate heat generated from each PTC into the inner space.

Herein, penetration holes 43 are co-axially disposed at the upper plate 27 and the lower plate 29 respectively so as to assist in smoothly flowing the ethanol fuel provided by the pump 5 therethrough.

However, in various embodiments of the present invention, the center axes of the penetration holes 43 of the upper plate 27 and the lower plate 29 may be offset so as to increase the stay time of ethanol fuel in the fuel pump module 1 so that heat transfer efficiency may be increased.

Further, one may appreciate that the relative distances among center axes of the first nipple 33, the penetration holes 43 of the upper plate 27 and the lower plate 29, and the second nipple 39 may be determined according to viscosity, pressure, input temperature, or etc of ethanol fuel.

In this case, the upper plate 27 and the lower plate 29 may preferably be made of a material such as a metal having comparably high heat conductivity, that is, copper, aluminum, iron, or the like.

A plurality of springs 31 may preferably be four, and they are interposed between the upper body 21 and the upper plate 27 so that the upper plate 27 and the lower plate 29 and each of the PTC elements 25 closely contact each other.

Herein, each spring 31 may preferably be a coil spring of which one end is supported by the inner surface of the upper body 21 and the other end is supported by a surface of the upper plate 27.

In other embodiments of the present invention, a plurality of springs may be further interposed between the lower body 23 and the lower plate 29. Accordingly each of the PTC elements 25 may more closely contact each other.

Furthermore the springs may function to raise the lower plate 29 and the upper plate 27 to form inner spaces between the lower body 23 and the lower plate 29 and between the upper body 21 and the upper plate 27 so that the contact surface for ethanol fuel to contact with the upper plate 27 and the lower plate 29 may be increased.

In further other embodiments of the present invention, the lower plate 29 may be spaced from the lower body 23 with a predetermined distance and the upper plate 21 may be spaced from the upper body 21 with a predetermined distance to increase the contact surface of the ethanol fuel.

Meanwhile, the supply hose 9, as shown in FIG. 5, comprises an inner pipe 45 through which the ethanol fuel is passed and an outer pipe 47 surrounding the inner pipe 45.

Therefore, the exterior diameter of the inner pipe 45 is smaller than the interior diameter of the outer pipe 47.

In this case, a space is defined between the exterior circumference of the inner pipe 45 and the interior circumference of the outer pipe 47.

Herein, the inner pipe 45 and the outer pipe 47 may be preferably made of a material that has low heat conductivity.

Additionally, the supply hose 9 further includes an insulator 49 between the exterior circumference of the inner pipe 45 and the interior circumference of the outer pipe 47.

As an example, the insulator 49 may be preferably made of a rubber such as Santoprene of a TPE (thermoplastic elastomer) series.

Herein, the insulator 49 maintains the temperature of the ethanol fuel at a predetermined temperature until the ethanol fuel heated through the heater unit 13 moves to the engine to be injected therein.

Hereinafter, an operation of fuel pump module 1 for an ethanol fuel vehicle according to various embodiments of the present invention will be described.

Firstly, ethanol fuel in the fuel tank 3 is pumped by the pump 5, and is moved to the inner space of the heater unit 13 through the connection hose 11.

At that time, the upper plate 27 and the lower plate 29 radiate heat of the PTC elements 25 to the inner space while the PTC elements 25 are maintained at a predetermined temperature by being heated using current provided from the power supply connector 15 via the terminal 35.

Then, ethanol fuel that is moved to the inner space of the heater unit 13 is heated and is moved to the supply portion 7 through the connection hose 11 by the pump 5.

The heated ethanol fuel in the supply portion 7 is transferred to the engine under pressure through the supply hose 9.

Herein, while the heated ethanol fuel passes through the inner pipe 45, its temperature is maintained by the insulator 49 such that it may be provided to the engine in a heated state.

Thus, vapor pressure of the ethanol fuel that is heated by the heater unit 13 is increased, and thereby high-pressure ethanol fuel is injected to improve startability of the ethanol fuel vehicle.

According to various embodiments of the present invention, during start-up of an ethanol fuel vehicle, ethanol fuel with an increased temperature is provided to the engine to thereby improve startability thereof.

Further, an auxiliary fuel tank employed therein according to the prior art so as to improve startability of ethanol fuel vehicles may be not required, and thereby the design can be simplified. Furthermore, fuel leaks can be prevented in case of accidents.

For convenience in explanation and accurate definition in the appended claims, the terms "upper", "lower", "interior", "exterior", "outer", and "inner" are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A fuel pump module for an ethanol fuel vehicle, which is mounted on a fuel tank for storing ethanol fuel and is provided with a pump and a supply portion for pressure-feeding the ethanol fuel stored in the fuel tank to an engine, the fuel pump module comprising a heater unit that is disposed therebetween and is fluid-communicated to the pump through a first connection hose and to the supply portion through a second connection hose so as to heat by electrical resistance the ethanol fuel supplied to the heater unit through the pump, wherein the heater unit comprises:

an upper body including a first nipple so as to be fluid-communicated to the supply portion through the second connection hose;

a lower body including a second nipple so as to be fluid-communicated to the pump through the first connection hose, wherein the lower body is coupled to and enclosed by the upper body in order to form an inner space therebetween;

a heating member mounted in the inner space and receiving electrical current from a power supply so as to generate heat;

upper and lower plates mounted respectively at upper and lower portions of the heating member so as to emit the heat generated from the heating member into the inner space, the upper and lower plates having respective penetration hole fluid-communicating with the first and second nipples therethrough; and an elastic member disposed in the inner space and biasing the upper plate and/or the lower plate toward the heating member to closely contact the upper and/or lower plates to the heating member.

2. The fuel pump module of claim 1 further comprising a power supply connector electrically coupled to the heater unit in order to supply electric current to the heater unit.

3. The fuel pump module of claim 1, wherein a connection socket having a terminal is mounted to the upper body and electrically connected to a power supply connector for receiving the electric current of the power supply.

4. The fuel pump module of claim 1, wherein the penetration holes of the upper and lower plates are coaxially aligned.

5. The fuel pump module of claim 1, wherein the first nipple and the penetration hole of the upper plate are coaxially aligned.

6. The fuel pump module of claim 1, wherein the second nipple and the penetration hole of the lower plate are coaxially aligned.

7. The fuel pump module of claim 1, wherein a first elastic member is interposed between the upper body and the upper plate and biases the upper plate toward the heating member to closely contact the upper plate to the heating member.

8. The fuel pump module of claim 1, wherein a second elastic member is interposed between the lower body and the lower plate and biases the lower plate toward the heating member to closely contact the lower plate to the heating member.

9. The fuel pump module of claim 1, wherein the lower plate is spaced from the lower body toward the upper body with a predetermined distance.

10. The fuel pump module of claim 1, wherein the upper plate is spaced from the upper body toward the lower body with a predetermined distance.

11. The fuel pump module of claim 1, wherein the heating member is a PTC (positive temperature coefficient) thermistor.

12. The fuel pump module of claim 1, wherein the lower body is thermally bonded to lower end portion of the upper body.

13. The fuel pump module of claim 1, wherein the supply portion is fluid-communicated to the engine through a supply hose having an inner pipe through which the ethanol fuel passes and an outer pipe enclosing the inner pipe.

14. The fuel pump module of claim 13, wherein an insulator is interposed between the inner pipe and the outer pipe.

15. The fuel pump module of claim 14, wherein the insulator is made of a rubber.

16. The fuel pump module of claim 15, wherein the insulator is made of Santoprene of a TPE (thermoplastic elastomer) series.

17. The fuel pump module of claim 1, wherein the upper plate and/or the lower plate is made of a material selected from the group consisting of copper, aluminum, and iron.

* * * * *